US006764163B2

(12) United States Patent
Anderson et al.

(10) Patent No.: US 6,764,163 B2
(45) Date of Patent: Jul. 20, 2004

(54) HEATER CONFIGURATION FOR TRI-COLOR HEATER CHIP

(75) Inventors: Frank Edward Anderson, Sadieville, KY (US); George Keith Parish, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/161,426

(22) Filed: May 31, 2002

(65) Prior Publication Data

US 2003/0222938 A1 Dec. 4, 2003

(51) Int. Cl.[7] ..... B41J 2/15
(52) U.S. Cl. ..... 347/40; 347/50
(58) Field of Search ..... 347/40, 85, 86, 347/56, 87, 50, 58

(56) References Cited

U.S. PATENT DOCUMENTS 5,030,971 A 7/1991 Drake et al.
5,880,756 A * 3/1999 Ishii et al. ..... 347/40
6,042,225 A * 3/2000 Altendorf et al. ..... 347/87
6,174,046 B1 * 1/2001 Reid et al. ..... 347/50
6,267,468 B1 7/2001 Torgerson et al.
6,315,389 B1 11/2001 Torgerson et al.

FOREIGN PATENT DOCUMENTS

JP 2000-015812 1/2000

* cited by examiner

*Primary Examiner*—Lamson Nguyen
(74) *Attorney, Agent, or Firm*—King & Schickli, PLLC

(57) ABSTRACT

A heater chip has a substrate with one inner and two outer ink vias adjacently arranged. Each via has a first and second longitudinal side. A plurality of heaters, formed by thin film layers, are grouped together in six rows where two of the six rows are arranged adjacent to the first longitudinal side of one of the two outer ink vias, two rows are arranged adjacent to either the first or second longitudinal side of the inner via, and two rows are arranged adjacent to the second longitudinal side of the other of the two outer ink vias. Each of the first, second, and third two rows have one row of near heaters and one row of far heaters. The near heaters are closer in distance to their respective ink via than the far heaters. Printheads containing the heater chip and printers are also disclosed.

19 Claims, 6 Drawing Sheets

HEATER CONFIGURATION FOR TRI-COLOR HEATER CHIP

FIELD OF THE INVENTION

The present invention relates to inkjet printheads. In particular, it relates to an optimum heater configuration for a printhead having a tri-color heater chip.

BACKGROUND OF THE INVENTION

The art of printing images with inkjet technology is relatively well known. In general, an image is produced by emitting ink drops from an inkjet printhead at precise moments such that they impact a print medium, such as a sheet of paper, at a desired location. The printhead is supported by a movable print carriage within a device, such as an inkjet printer, and is caused to reciprocate relative to an advancing print medium and emit ink drops at such times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

A conventional thermal inkjet printhead includes access to a local or remote supply of color or mono ink, a heater chip, a nozzle or orifice plate attached to the heater chip, and an input/output connector, such as a tape automated bond (TAB) circuit, for electrically connecting the heater chip to the printer during use. The heater chip, in turn, typically includes a plurality of thin film resistors or heaters fabricated by deposition, masking and etching techniques on a substrate such as silicon.

To print or emit a single drop of ink, an individual heater is uniquely addressed with a small amount of current to rapidly heat a small volume of ink. This causes the ink to vaporize in a local ink chamber (between the heater and nozzle plate) and be ejected through and projected by the nozzle plate towards the print medium.

As demands for higher resolution and increased printing speed continue, however, heater chips are made with more and denser heater configurations. Thus, heater chip size, fragility, and heat dissipation become implicated with all future designs.

Accordingly, the inkjet printhead arts desire optimum heater configurations supporting relatively small size, high density, chip stability and good heat dissipation properties.

SUMMARY OF THE INVENTION

The above-mentioned and other problems become solved by applying the apparatus and method principles and teachings associated with the hereinafter described heater configuration for a tri-color heater chip.

In one embodiment, the heater chip has a substrate with one inner and two outer ink vias adjacently arranged therein. Each ink via has a first and second longitudinal side. A plurality of heaters, formed by thin film layers on the substrate, are grouped together in six rows wherein a first two rows of the six rows are arranged adjacent to the first longitudinal side of one of the two outer ink vias, a second two rows of the six rows are arranged adjacent to either the first or second longitudinal side of the inner via, and a third two rows of the six rows are arranged adjacent to the second longitudinal side of the other of the two outer ink vias. Even further, the first, second, and third two rows each have one row of near heaters and one row of far heaters where the one row of near heaters are closer in distance to their respective ink via in comparison to the one row of far heaters.

In other embodiments, the six rows are staggered, the vertically adjacent heaters are contained in separate rows of the six rows and separated by about $1/600^{th}$ of an inch, and the near and far heaters are arranged in five groupings of sixteen heaters. During use, up to ten heaters per via can be substantially simultaneously fired in sixteen consecutive firings.

Printheads containing the heater chip and printers containing the printhead are also disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the inventions may be practiced. These embodiments are described in sufficient detail to enable those skilled in the art to practice the invention, and it is to be understood that other embodiments may be utilized and that process, electrical or mechanical changes may be made without departing from the scope of the present invention. The terms wafer and substrate used in this specification include any base semiconductor structure such as silicon-on-sapphire (SOS) technology, silicon-on-insulator (SOI) technology, thin film transistor (TFT) technology, doped and undoped semiconductors, epitaxial layers of a silicon supported by a base semiconductor structure, as well as other semiconductor structures well known to one skilled in the art. The following detailed description is, therefore, not to be taken in a limiting sense, and the scope of the present invention is defined only by the appended claims and their equivalents.

Figure 1:
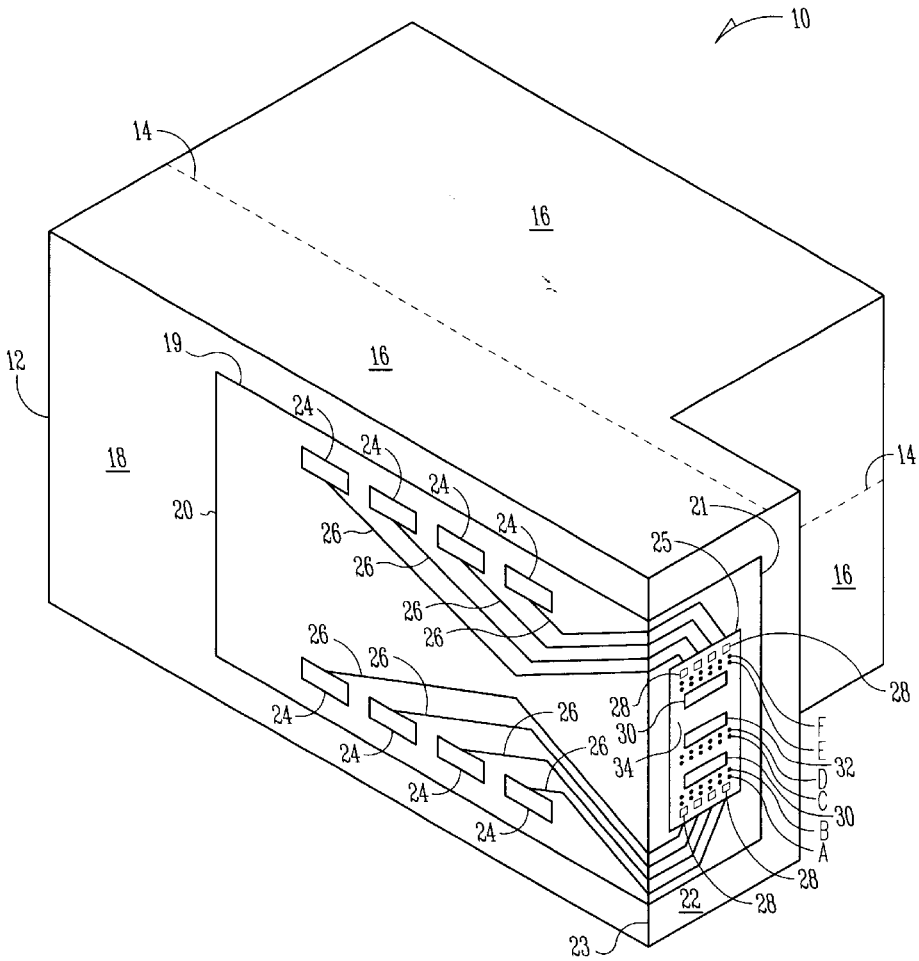
FIG. 1 is a perspective view in accordance with the teachings of the present invention of a thermal inkjet printhead.

With reference to FIG. 1, a printhead of the present invention having a tri-color heater chip incorporating thermal inkjet technology is shown generally as 10. The printhead 10 has a housing 12 formed of any suitable material for holding ink. Its shape can be varied and is often dependent upon the external device that carries or contains the printhead. The housing has several compartments internal thereto for holding an initial or refillable supply of ink. In one embodiment, as shown by the dashed lines 14, the compartments 16 are three in number and contain three supplies of ink. Preferably, they include cyan, magenta and yellow ink. In other embodiments, the compartments may contain black ink, photo-ink and/or plurals of cyan, magenta or yellow ink. It will be appreciated that the compartments 16 while shown as locally integral within the housing 12 may alternatively be connected to a remote source of ink and fed from a supply tube, for example.

Adhered to one surface 18 of the housing 12 is a portion 19 of a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 has a plurality of input/output (I/O) connectors 24 fabricated thereon for electrically connecting the heater chip 25 to an external device, such as a printer, fax machine, copier, photo-printer, plotter, all-in-one, etc., during use.

Pluralities of electrical conductors 26 exist on the TAB circuit 20 to electrically connect and short the I/O connectors 24 to the bond pads 28 of the heater chip 25 of the present invention. Various techniques are known for facilitating such connections. It will be appreciated that while eight I/O connectors 24, eight electrical conductors 26 and eight bond pads 28 are shown, any number greater than one are equally embraced herein. It is also to be appreciated that such number of connectors, conductors and bond pads may not be equal to one another, but for simplicity, equal numbers are shown.

The heater chip 25 is arranged on the surface 22 of the housing 12 as either a bottom, top or side of the printhead 10. In accordance with such arrangement, the printhead becomes known as a top-, or roof-shooter style printhead and all embodiments are embraced herein.

The heater chip 25 contains at least three ink vias comprised of two outer 30 and one inner via 32 adjacently arranged with respect to one another. Each via is formed, preferably by one of the well known processes of grit blasting, deep reactive ion etching, wet etching, laser cutting, or plunge cutting, in a substrate 34 of the heater chip. Each has fluidic access to one of the supplies of ink contained in one of the compartments 16. The heater chip 25 is preferably attached to the housing with any of a variety of adhesives, epoxies, etc. well known in the art.

The heater chip contains at least six rows (rows A–row F) of a plurality of heaters for the three ink vias, i.e., two outer vias 30 and one inner via 32. For simplicity in this crowded figure, the pluralities of heaters in rows A through F are shown as dots. Two rows are shown for each via. Rows A and B for one of the two outer vias 30, rows C and D for the inner via 32 and rows E and F for the other of the two outer vias 30. As will be described in greater detail below, rows A, C and F are further defined as rows of far heaters, while rows B, D and E are further defined as rows of near heaters. Such rows of near and far heaters are a reference to a distance of the rows to their respective ink vias. As implied by their names, the row of near heaters is closer in distance to its ink via than the row of far heaters. For example, near row, row D, is closer to inner via 32 than far row, row C.

Figure 2:
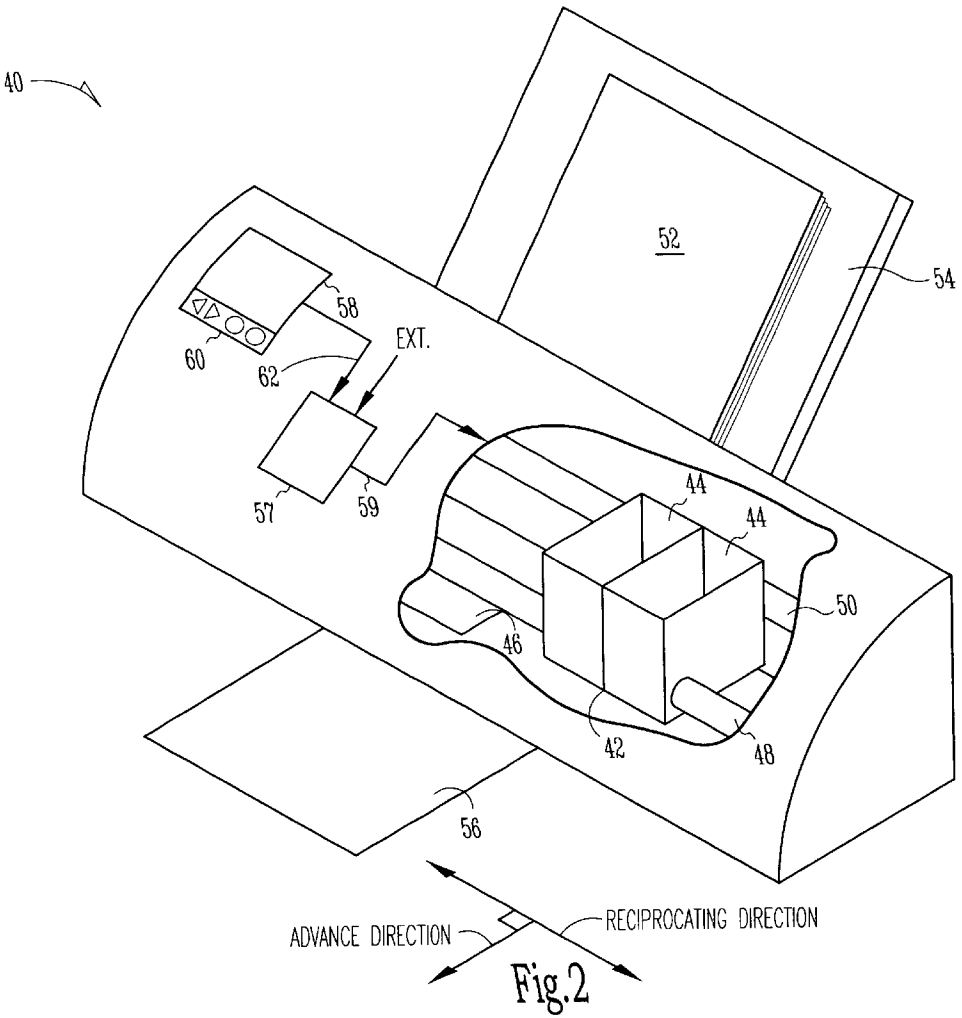
FIG. 2 is a perspective view in accordance with the teachings of the present invention of an inkjet printer.

With reference to FIG. 2, an external device, in the form of an inkjet printer, for containing the printhead 10 is shown generally as 40. The printer 40 includes a carriage 42 having a plurality of slots 44 for containing one or more printheads 10. The carriage 42 is caused to reciprocate (via an output 59 of a controller 57) along a shaft 48 above a print zone 46 by a motive force supplied to a drive belt 50 as is well known in the art. The reciprocation of the carriage 42 is performed relative to a print medium, such as a sheet of paper 52, that is advanced in the printer 40 along a paper path from an input tray 54, through the print zone 46, to an output tray 56.

In the print zone, the carriage 42 reciprocates in the Reciprocating Direction generally perpendicularly to the paper 52 being advanced in the Advance Direction as shown by the arrows. Ink drops from compartments 16 (FIG. 1) are caused to be ejected from the heater chip 25 at such times pursuant to commands of a printer microprocessor or other controller 57. The timing of the ink drop emissions corresponds to a pattern of pixels of the image being printed. Often times, such patterns are generated in devices electrically connected to the controller 57 (via Ext. input) that are external to the printer such as a computer, a scanner, a camera, a visual display unit, a personal data assistant, etc.

To print or emit a single drop of ink, the heaters (the dots of rows A–F, FIG. 1) are uniquely addressed with a small amount of current to rapidly heat a small volume of ink. This causes the ink to vaporize in a local ink chamber 120 (FIG. 6) and be ejected through, and projected by, a nozzle plate (not shown) towards the print medium.

A control panel 58 having user selection interface 60 may also be provided as an input 62 to the controller 57 to provide additional printer capabilities and robustness.

Figure 3:
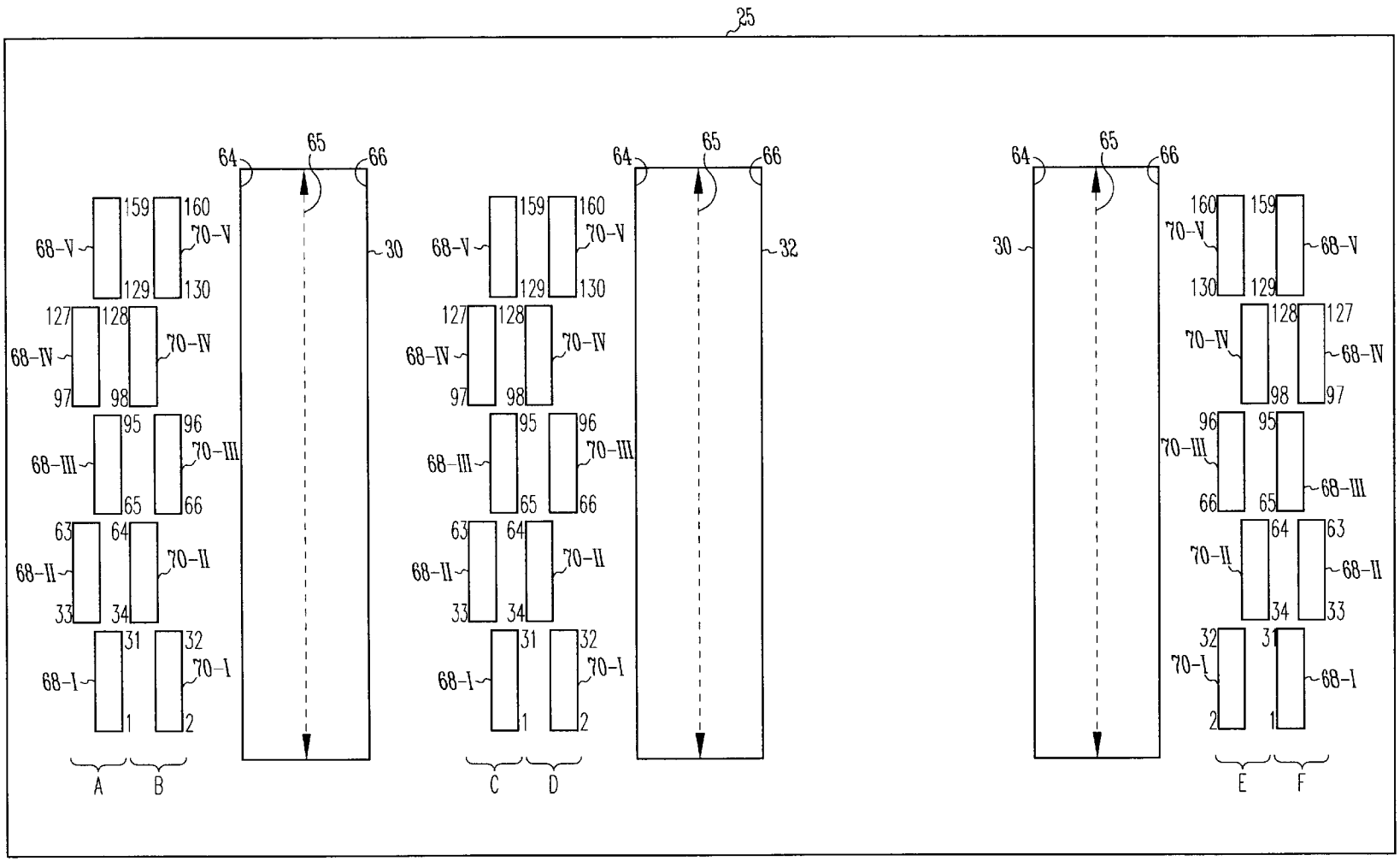
FIG. 3 is a diagrammatic view in accordance with the teachings of the present invention of a tri-color heater chip.

With reference to FIG. 3, a more detailed embodiment of the heater chip 25 of the printhead 10 is shown. In particular, each ink via has a longitudinal axis shown by the dashed line 65 and a first longitudinal side 64 and a second longitudinal side 66 on either side thereof that run the length of the longitudinal axis. It will be appreciated that the at least six rows of heaters, rows A–F, are arranged adjacent their respective ink via on only one longitudinal side thereof. For example: i) a first two rows of the six rows, rows A and B, are arranged adjacent to the first longitudinal side 64 of one of the two outer ink vias 32 (the leftmost outer via as shown); ii) a second two rows of the six rows, rows C and D, are arranged adjacent to the first longitudinal side 64 of the inner via 32; and iii) a third two rows of the six rows, rows E and F, are arranged adjacent to the second longitudinal side 66 of the other of the two outer ink vias 32 (the rightmost outer via as shown).

It should be further appreciated that in each of the first, second, and third two rows, each two rows has one row of near heaters (rows B, D and E) and one row of far heaters (rows A, C and F) with the one row of near heaters being closer in distance to their respective ink via in comparison to the one row of far heaters.

Even further, it can be seen that each row A–F of the pluralities of heaters includes five groupings of heaters having odd or even numbering schemes. The rows of far heaters (rows A, C and F) have odd numbering schemes and include groupings 68-I through 68-V while the rows of near heaters (rows B, D and E) have even numbering schemes and include groupings 70-I through 70-V. It will be appreciated that the odd and even numbering schemes correspond to a sequence of firing the heaters as will be described later. In the embodiment shown, the odd numbering scheme includes sixteen heaters numbered alternatively between 1–31 for group 68-I; sixteen heaters numbered alternatively between 33–63 for group 68-II; sixteen heaters numbered alternatively between 65–95 for group 68-III; sixteen heaters numbered alternatively between 97–127 for group 68-IV; and sixteen heaters numbered alternatively between 129–159 for group 68-V. The even numbering scheme includes sixteen heaters numbered alternatively between 2–32 for group 70-I; sixteen heaters numbered alternatively between 34–64 for group 70-II; sixteen heaters numbered alternatively between 66–96 for group 70-III; sixteen heaters numbered alternatively between 98–128 for group 70-IV; and sixteen heaters numbered alternatively between 130–160 for group 70-V. In a preferred embodiment, each group of the five groupings 68-I through 68-V and 70-I through 70-V are staggered with respect to adjacent groups. Some groups are closer to the via while others are farther away. In still another preferred embodiment, the staggered arrangement of the groupings of odd numbering schemes substantially parallels the staggered arrangement of the groupings of even numbering schemes.

While the rows of heaters, rows C and D, are adjacently arranged next to inner via 32 along the first longitudinal side 64, it will be appreciated they could alternatively be arranged on the second longitudinal side 66. Likewise, the arrangements of rows with respect to the two outer ink vias 30, could individually or together be mirror images of that shown such that rows A and B are adjacently arranged about the second longitudinal side 66 of its via and that rows E and F are adjacently arranged about the first longitudinal side 64 of its via.

Figure 4:
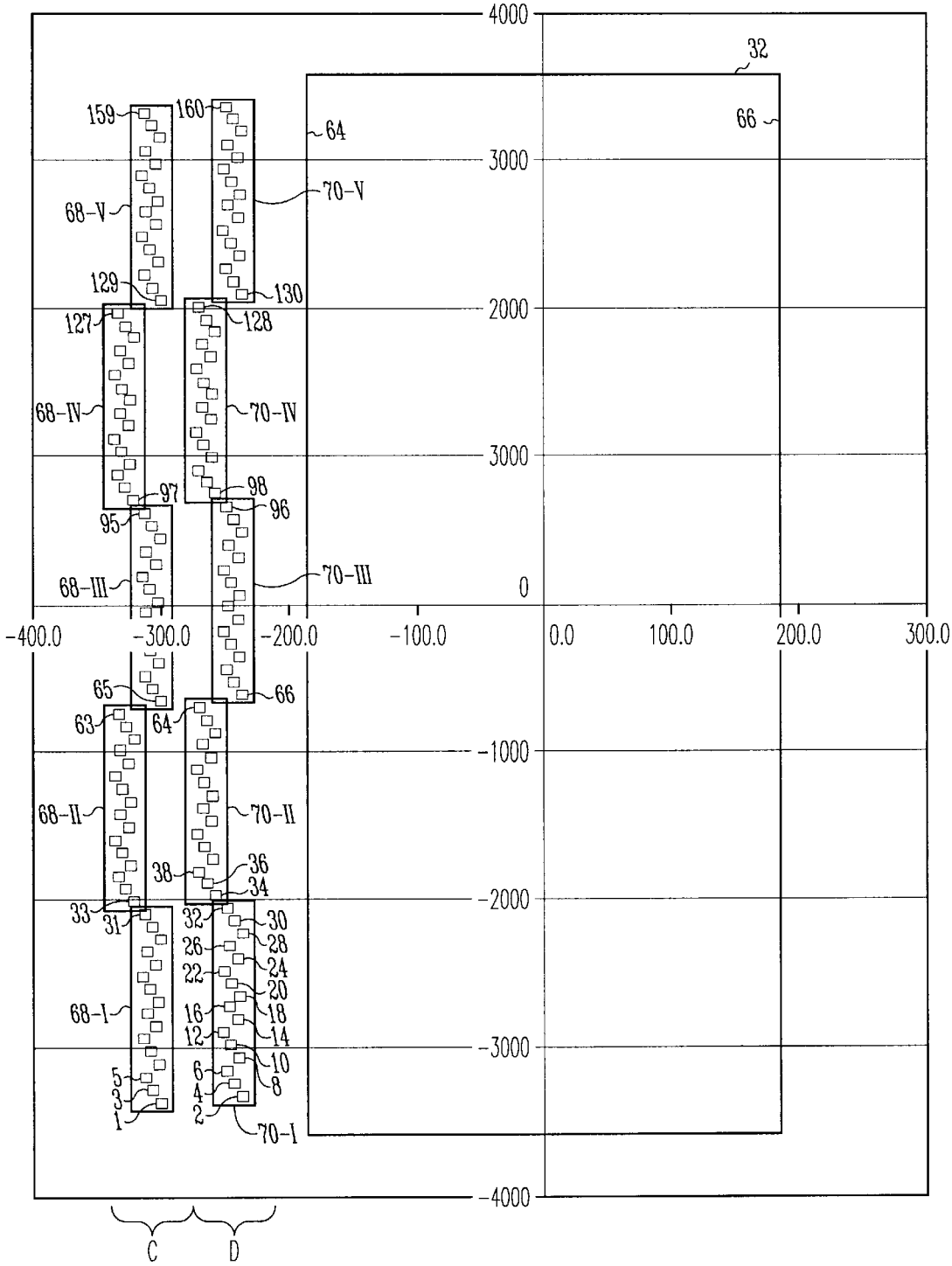
FIG. 4 is a diagrammatic view in accordance with the teachings of the present invention of a heater configuration corresponding to a single ink via of the tri-color heater chip of FIG. 3.

With reference to FIG. 4, a more detailed and scaled embodiment (in microns) of a single ink via (the inner via 32) and its rows of heaters (rows C and D) is shown. In this embodiment, all individual heaters in a single grouping of heaters are substantially equal in distance to other similarly situated heaters in other groupings. For example, heater number 4 in grouping 70-I is dimensionally the same with respect to heaters numbered 2 and 6, as is heater number 36 with respect to heaters numbered 34 and 38 in grouping 70-II. Even further, it will be appreciated that this figure applies equally to any of the vias and rows of heater. Heater numbers not shown, in order to keep the drawing simple, can be figured by counting by twos in any one individual row of heaters until heater number 159, for the far row, and 160, for the near row is reached.

Figure 5:
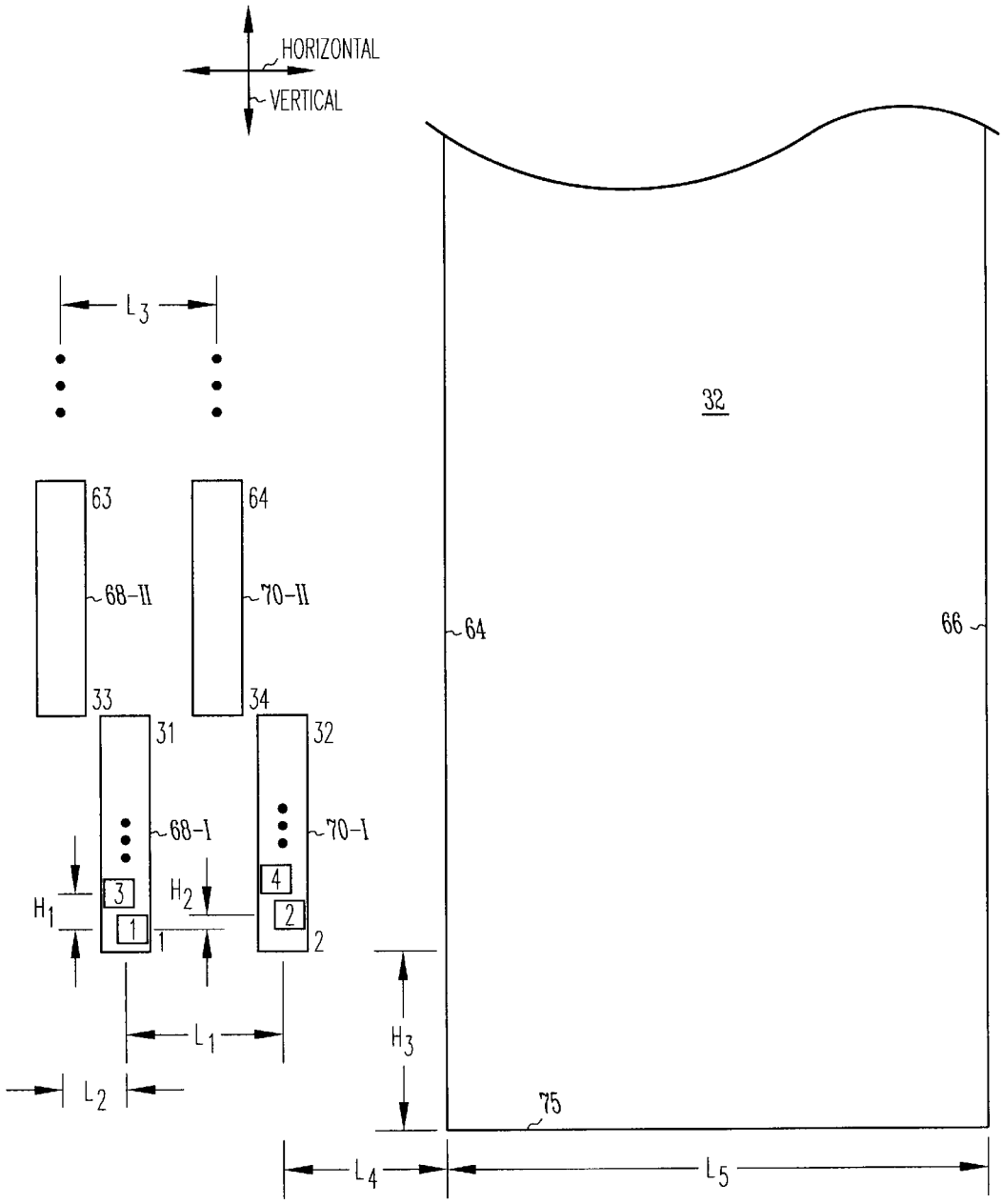
FIG. 5 is a diagrammatic view in accordance with the teachings of the present invention of the dimensions of the heater configuration of FIG. 4.

With reference to FIG. 5, a partial embodiment of that shown in FIG. 4 is presented so that preferred inner heater spacing dimensions can be given. By convention herein, the term horizontal or vertical spacing is merely a reference of a planar view of the heater chip as shown between the left and right sides in the figure (when the paper is oriented so that the letters and numbers are upright for reading) and between the top and bottom sides. Horizontal and Vertical arrows show these directions and should not be used to limit the physical layout of the thin film stack of the heater chip to horizontal or vertical dimensions as shown in a later figure.

In this embodiment, the horizontal spacing between any of the near rows (row D) and its closest far row (row C) is about $3/1200^{th}$ of an inch and is shown by dimension L1 for spacing between groupings 68-I and 70-I and L3 for spacing between groupings 68-II and 70-II. In another embodiment, the spacing is any $n/1200^{th}$ where n is an odd number. The horizontal distance of stagger between groupings of the same near or far rows, such as shown by dimension L2 between grouping 68-I and 68-II, is about $1/200^{th}$ of an inch.

The horizontal spacing of the closest heaters of the near rows to the longitudinal side of its via, as shown by dimension L4 between grouping 70-I of near row, row D, and the first longitudinal side 64 of the inner via 32, is about 65 microns. The horizontal spacing of the ink via, as shown by dimension L5 between the first longitudinal side 64 and the second longitudinal side 66 of the inner via 32, is about 370 microns.

The vertical spacing between the bottom edge 75 of the inner via 32 to its closest vertical heater, heater number 1 in grouping 68-I, as shown by dimension H3, is about 190 microns.

The vertical spacing between any two heaters in a row of either far or near heaters, as shown by dimension H1 between heater numbered 1 and heater numbered 3 in grouping 68-I, is about $1/300^{th}$ of an inch. It will be appreciated that such spacing is the same for even numbered heaters such as between heaters numbered 2 and 4 in grouping 70-I. It is also true of heaters spanning various groupings in the same row. For example, the vertical spacing between heater number 31 in grouping 68-I in far row, row C, and heater number 33 in grouping 68-II in far row, row C, is about $1/300^{th}$ of an inch.

Finally, vertically adjacent ones of the plurality of heaters (such as between heaters numbered 1 and 2, heaters numbered 2 and 3, heaters numbered 3 and 4, etc. through heaters numbered 159 and 160) are contained in separate rows of the six rows (i.e., heater number 1 is in row C while heater number 2 is in row D) and are vertically spaced apart by about $1/600^{th}$ of an inch as shown by dimension H2 between heaters numbered 1 and 2. In this embodiment, this dimension reflects the printing resolution of the printer.

Figure 6:
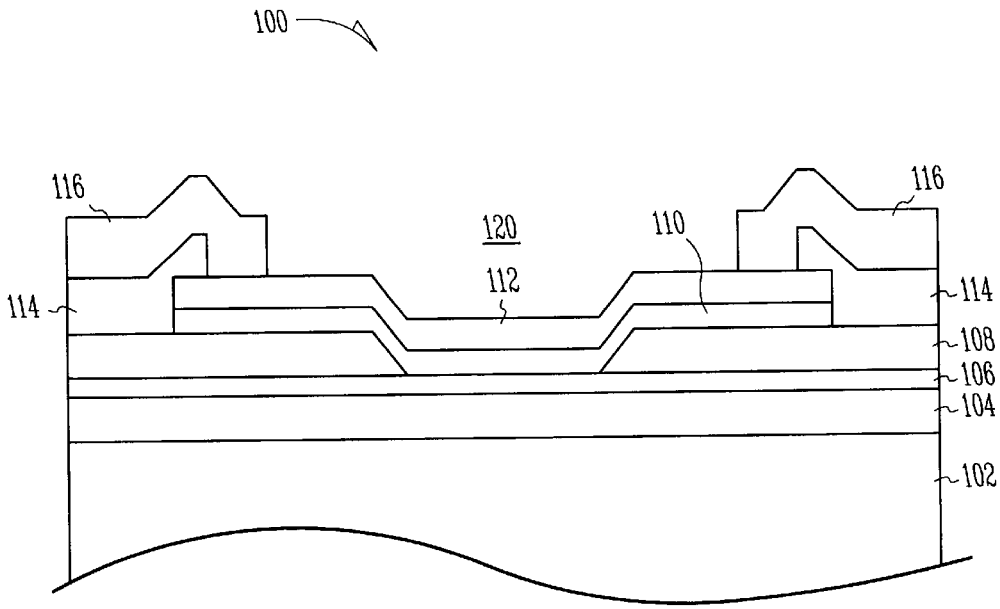
FIG. 6 is a cross sectional view in accordance with the teachings of the present invention of a single heater.

With reference to FIG. 6, a preferred embodiment of an individual heater stack of the pluralities of heaters in the near and far rows of heaters is shown generally as 100. It will be appreciated that what is depicted in these figures is the result of a substrate having been processed through a series of growth layers, deposition, masking, photolithography, and/or etching or other processing steps. Some of the preferred deposition techniques for the hereinafter described layers include, but are not limited to, any variety of chemical vapor depositions (CVD), physical vapor depositions (PVD), epitaxy, evaporation, sputtering or other similarly known techniques. Preferred CVD techniques include low pressure (LP) ones, but could also be atmospheric pressure (AP), plasma enhanced (PE), high density plasma (HDP) or other. Preferred etching techniques include, but are not limited to, any variety of wet or dry etches, reactive ion etches, deep reactive ion etches, etc. Preferred photolithography steps include, but are not limited to, exposure to ultraviolet or x-ray light sources, or other, and photomasking includes photomasking islands and/or photomasking holes. The particular embodiment, island or hole, depends upon whether the configuration of the mask is a clear-field or dark-field mask as those terms as well understood in the art.

The resulting heater 100 is a series of thin film layers. In particular, a substrate 102 provides the base layer upon which all other layers will be formed and, in one embodiment, is a silicon wafer of p-type, 100 orientation, wafer having a resistivity of 5–20 ohm/cm. Its beginning thickness is preferably, but is not required to be, any one of 525+/−20 microns, 625+/−20 microns, or 625+/−15 microns with respective wafer diameters of 100+/−0.50 mm, 125+/−0.50 mm, and 150+/−0.50 mm.

The next layer is a thermal barrier layer 104. Some embodiments of the layer include a silicon oxide layer mixed with a glass such as BPSG, PSG or PSOG with an exemplary thickness of about or 1.82+/−0.15 microns. Subsequent to the thermal barrier layer is the heater layer 106. Preferably, the heater layer is about a 50—50% tantalum-aluminum composition layer of about 1000 angstroms thick. The metal layer 108 overlies the heater layer and is, in one embodiment, about a 99.5–0.5% aluminum-copper composition of about 5000+/−10% angstroms thick. The passivation layer 110 is preferably a dual layer of silicon-carbide (SiC) and silicon-nitride (SiN) each having a nominal thickness of about 4400+/−400 angstroms and 2600+/−250 angstroms, respectively. The cavitation layer 112 is processed subsequent to the passivation layer and in one embodiment is a tantalum (Ta) layer having a thickness of about 4500+/−500 angstroms. The inner metallic dielectric layer 114 is preferably a composition of three layers of silicon-oxide, spun glass PSOG, and silicon oxide with a respective thickness of about 4000+/−800 angstroms, 1800+/−300 angstroms, and 4000+/−800 angstroms. The final layer shown is a second passivation layer of silicon nitride (SiN) having an exemplary thickness of 8000+/−800 angstroms. A nozzle plate, not shown, is eventually attached to the foregoing described heater 100 to direct and project ink drops, formed in an ink chamber area 120 generally above the heater, onto a print medium during use.

In one embodiment, the far heaters and the even heaters are of different dimensions as a function of heater chip power management. Such dimensions, in surface area of the heater layer 106, are summarized in Table 1 below for both odd numbered (far) and even numbered (near) heaters.

TABLE 1

| | Heater Geometry in Microns | | | |
|---|---|---|---|---|
| | ODD Length | ODD Width | EVEN Length | EVEN Width |
| Heater Layer | 35 | 15 | 36.6 | 13.2 |

During use, the individual heaters are uniquely addressed to fire them in a particular order. As is known, heaters have a primitive line, P, and an address line, A, for addressing. In this invention, the heater chip has discrete bond pads 28 (FIG. 1) on the first longitudinal side 64 of one of the outer ink vias 30 and the second longitudinal side 66 of the other of the ink vias 30 for each of the following: primitive lines, PX, where X is a number between 1 and 5, inclusive; the address lines, AY, where Y is a number between 1 and 4, inclusive; two fire lines, F1 and F2; and two EA lines EA1 and EA2; so that the firing of the heaters of the heater chip can be controlled in accordance with the depiction in Table 2.

TABLE 2

| | Addressing Scheme for Firing Individual Heater Numbers for Near and Far Rows for Each of the Inner and Outer Ink Vias | | | | | | | | | | | | | | | |
|---|---|---|---|---|---|---|---|---|---|---|---|---|---|---|---|---|
| | A1 F1 EA1 | A1 F2 EA1 | A2 F1 EA1 | A2 F2 EA1 | A3 F1 EA1 | A3 F2 EA1 | A4 F1 EA1 | A4 F2 EA1 | A1 F1 EA2 | A1 F2 EA2 | A2 F1 EA2 | A2 F2 EA2 | A3 F1 EA2 | A3 F2 EA2 | A4 F1 EA2 | A4 F2 EA2 |
| P1 | 1 | 7 | 13 | 3 | 9 | 15 | 5 | 11 | 2 | 8 | 14 | 4 | 10 | 16 | 6 | 12 |
| P2 | 27 | 17 | 23 | 29 | 19 | 25 | 31 | 21 | 28 | 18 | 24 | 30 | 20 | 26 | 32 | 22 |
| P3 | 34 | 40 | 46 | 36 | 42 | 48 | 38 | 44 | 33 | 39 | 45 | 35 | 41 | 47 | 37 | 43 |
| P4 | 60 | 50 | 56 | 62 | 52 | 58 | 64 | 54 | 59 | 49 | 55 | 61 | 51 | 57 | 63 | 53 |
| P5 | 65 | 71 | 77 | 67 | 73 | 79 | 69 | 75 | 66 | 72 | 78 | 68 | 74 | 80 | 70 | 76 |
| P6 | 91 | 81 | 87 | 93 | 83 | 89 | 95 | 85 | 92 | 82 | 88 | 94 | 84 | 90 | 96 | 86 |
| P7 | 98 | 104 | 110 | 100 | 106 | 112 | 102 | 108 | 97 | 103 | 109 | 99 | 105 | 111 | 101 | 107 |
| P8 | 124 | 114 | 120 | 126 | 116 | 122 | 128 | 118 | 123 | 113 | 119 | 125 | 115 | 121 | 127 | 117 |
| P9 | 129 | 135 | 141 | 131 | 137 | 143 | 133 | 139 | 130 | 136 | 142 | 132 | 138 | 144 | 134 | 140 |
| P10 | 155 | 145 | 151 | 157 | 147 | 153 | 159 | 149 | 156 | 146 | 152 | 158 | 148 | 154 | 160 | 150 |
| | 1 | 2 | 3 | 4 | 5 | 6 | 7 | 8 | 9 | 10 | 11 | 12 | 13 | 14 | 15 | 16 |

It will be appreciated that the above table represents 16 consecutive firings of up to ten substantially simultaneously fired heaters as controlled by input lines A, F, EA, and P. For example, as shown in the first column 1, with EA1 selected, the first firing of ten heaters (heaters numbered 1, 27, 34, 60, 65, 91, 98, 124, 129, and 155) occurs when all primitives P1–P10 and address and fire A1, F1 are selected. The next consecutive firing of ten heaters (heaters numbered 7, 17, 40, 50, 71, 81, 104, 114, 135, and 145 in column 2) occurs when P1–P10 and A1, F2 are selected. Heater firing continues in this manner until the $16^{th}$ firing of ten heaters (heaters numbered 12, 22, 43, 53, 76, 86, 107, 117, 140, and 150 in column 16) when EA2 and P1–P10 and A4, F2 are selected.

It will be appreciated that in any one column of heater firings, no more than two heaters can be fired from any one of the groupings of heaters. For example, in column 1, the first firing with A1, F1 and EA1 selected, and heaters numbered 1, 27, 34, 60, 65, 91, 98, 24, 129 and 155 fired, heaters numbered 1 and 27 are contained in one of the groupings of the far row of heaters as 68-I (FIG. 3), heaters numbered 34 and 60 are contained in one of the groupings of the near row of heaters as 70-I, heaters numbered 65 and 91 are contained in another of the groupings of the far row of heaters as 68-III, heaters numbered 98 and 124 are contained in another of the groupings of the near row of heaters as 70-IV, and heaters numbered 129 and 155 are contained in still another grouping of the far row of heaters as 68-V. In other words, more than two heaters in any one of the five groupings of sixteen heaters for either the groupings of the near or far rows of heaters (such as shown in FIG. 3) are prevented from firing in the substantially simultaneous fire of the up to ten heaters addressed at any one time. Such is true of any of the sixteen columns depicting the sixteen consecutive and substantially simultaneous firings of the up to ten of the plurality of heaters.

For still improved power management, two power line busses are provided on the heater chip for each of three ink vias. In one embodiment, two power line busses are provided for a cyan ink via, two for a magenta ink via and two for a yellow ink via with the consecutive firings of heaters containing not more than two odd numbered or two even numbered heaters being fired per one of the two power line busses. For example, in column 1, the first firing with A1, F1 and EA1 selected, and heaters numbered 1, 27, 34, 60, 65, 91, 98, 124, 129 and 155 fired, the first power line buss for the ink via powers the firing of the first five heaters, numbered 1, 27, 34, 60, and 65 while the second power line buss powers the firing of the next five heaters, numbered 91, 98, 124, 129, and 155. In column 2, the second firing with A1, F2 and EA1 selected, and heaters numbered 7, 17, 40, 50, 71, 81, 104, 114, 135, and 145 fired, the first power line buss for the ink via powers the firing of the first five heaters, numbered 7, 17, 40, 50, and 71 while the second power line buss powers the firing of the next five heaters, numbered 81, 104, 114, 135, and 145. Powering the first five numbered heaters on one of the two power busses and powering the second five numbered heaters on the other of the two power busses continues in this manner for all sixteen consecutive firings such that the last firing has the first power line buss for the ink via powering the firing of the first five heaters, numbered 12, 22, 43, 53, and 76 while the second power line buss powers the firing of the next five heaters, numbered 86, 107, 117, 140, and 150.

In this manner, it has been discovered that inkjet printheads, printers and heater chips can have an optimum heater configuration supporting relatively small size, high density, chip stability and good heat dissipation properties.

The present invention has been particularly shown and described with respect to certain preferred embodiment(s). However, it will be readily apparent to those skilled in the art that a wide variety of alternate embodiments, adaptations or variations of the preferred embodiment(s), and/or equivalent embodiments may be made without departing from the intended scope of the present invention as set forth in the appended claims. Accordingly, the present invention is not limited except as by the appended claims.

What is claimed is:

1. A heater chip, comprising:

a substrate having a plurality of thin film layers arranged thereon;

two outer ink vias and one inner ink via adjacently arranged in the substrate each having a first and second longitudinal side; and a plurality of heaters formed by the thin film layers grouped together in at least six rows wherein a first two rows of the six rows are arranged adjacent to the first longitudinal side of one of the two outer ink vias, a second two rows of the six rows are arranged adjacent to one of the first and second longitudinal sides of the inner via, and a third two rows of the six rows are arranged adjacent to the second longitudinal side of the other of the two outer ink vias, each of the first, second, and third two rows having one row of near heaters and one row of far heaters with the one row of near heaters being closer in distance to the ink via than the one row of far heaters, wherein each one row of near heaters and far heaters contains five groupings of sixteen heaters.

2. The heater chip of claim 1, wherein the one row of near heaters and the one row of far heaters are staggered.

3. The heater chip of claim 1, wherein the one row of near heaters and the one row of far heaters are horizontally spaced apart by one of about $1/1200^{th}$ and about $n/1200^{th}$, where n is an odd number, of an inch.

4. The heater chip of claim 1, wherein the plurality of heaters in the one row of near heaters and in the one row of far heaters are vertically spaced apart by about $1/300^{th}$ of an inch.

5. The heater chip of claim 1, wherein vertically adjacent ones of the plurality of heaters are contained in separate rows of the six rows and are spaced apart by about $1/600^{th}$ of an inch.

6. A heater chip, comprising:

a substrate having a plurality of thin film layers arranged thereon;

two outer ink vias and one inner ink via adjacently arranged in the substrate each having a first and second longitudinal side; and a plurality of heaters formed by the thin film layers grouped together in exactly six staggered rows wherein vertically adjacent ones of the plurality of heaters are contained in separate rows of the six staggered rows and are spaced apart by about $1/600^{th}$ of an inch and wherein a first two rows of the six staggered rows are arranged adjacent to the first longitudinal side of one of the two outer ink vias, a second two rows of the six staggered rows are arranged adjacent to the first longitudinal side of the inner via, and a third two rows of the six staggered rows are arranged adjacent to the second longitudinal side of the other of the two outer ink vias, each of the first, second, and third two rows having one row of near heaters and one row of far heaters containing five groupings of sixteen heaters each with the one row of near heaters being closer in distance to the ink via in comparison to the one row of far heaters.

7. The heater chip of claim 6, wherein each heater of the one row of near heaters has area dimensions of about 36.6 microns by about 13.2 microns.

8. The heater chip of claim 6, wherein each heater of the one row of far heaters has area dimensions of about 35 microns by about 15 microns.

9. An inkjet printhead, comprising:

three supplies of ink; and a heater chip having a substrate with a plurality of thin film layers arranged thereon;

two outer ink vias and one inner ink via adjacently arranged in the substrate each having a first and second longitudinal side wherein each of the ink vias has fluidic access to one of the three supplies of ink; and a plurality of heaters formed by the thin film layers grouped together in at least six rows wherein a first two of the six rows are arranged adjacent to the first longitudinal side of one of the two outer ink vias, a second two of the six rows are arranged adjacent to one of the first and second longitudinal sides of the inner via, and a third two of the six rows are arranged adjacent to the second longitudinal side of the other of the two outer ink vias, each of the first, second, and third two rows having one row of near heaters and one row of far heaters with the one row of near heaters being closer in distance to the ink via in comparison to the one row of far heaters, wherein each one row of near heaters and far heaters contains five groupings of sixteen heaters.

10. The printhead of claim 9, further having a TAB circuit for providing an electrical connection between the plurality of heaters and an external device.

11. The printhead of claim 10, further having an addressing scheme for each of the first, second and third two rows to allow sixteen substantially simultaneous firings often of the plurality of heaters.

12. The printhead of claim 11, further having two power busses for each of the first, second and third two rows wherein the ten of the plurality of heaters includes not more than three heaters from the one row of far heaters or the one row of near heaters for any one of the two power busses.

13. The printhead of claim 12, wherein each power bus of the two power busses for each of the first, second and third two rows have a dedicated bond pad on the heater chip.

14. The printhead of claim 13, wherein the dedicated bond pads are arranged adjacent to one of the first longitudinal side of the one of the two outer ink vias and the second longitudinal side of the other of the two outer ink vias.

15. The printhead of claim 9, wherein the three supplies of ink are locally configured within a housing of the printhead.

16. A printer, comprising:

at least one printhead having three supplies of ink and a heater chip, the heater chip having i) a substrate having a plurality of thin film layers arranged thereon;

ii) two outer ink vias and one inner ink via adjacently arranged in the substrate each having a first and second longitudinal side wherein each of the ink vias has fluidic access to one of the three supplies of ink; and iii) a plurality of heaters formed by the thin film layers grouped together in exactly six staggered rows wherein vertically adjacent ones of the plurality of heaters are contained in separate rows of the six staggered rows and are spaced apart by about $1/600^{th}$ of an inch and wherein a first two rows of the six staggered rows are arranged adjacent to the first longitudinal side of one of the two outer ink vias, a second two rows of the six staggered rows are arranged adjacent to the first longitudinal side of the inner via, and a third two rows of the six staggered rows are arranged adjacent to the second longitudinal side of the other of the two outer ink vias, each of the first, second, and third two rows having one row of near heaters and one row of far heaters containing five groupings of sixteen heaters each with the one row of near heaters being closer in distance to the ink via in comparison to the one row of far heaters; and a carriage for holding the at least one printhead capable of reciprocating movement over a print zone during use.

17. The printer of claim 16, wherein the printhead has an addressing scheme for each of the first, second and third two rows to allow sixteen substantially simultaneous firings often of the plurality of heaters.

18. The printer of claim 17, wherein only up to two heaters in any one of the five groupings of sixteen heaters are able to fire in the substantially simultaneous firings of the ten of the plurality of heaters.

19. A method of printing with a tri-color heater chip, comprising:

providing a substrate having a plurality of heaters formed by a plurality of thin film layers, the heaters being grouped together in exactly six staggered rows wherein vertically adjacent ones of the plurality of heaters are contained in separate rows of the six staggered rows and are spaced apart by about $1/600^{th}$ of an inch and wherein a first two rows of the six staggered rows are arranged adjacent to the first longitudinal side of one of the two outer ink vias, a second two rows of the six staggered rows are arranged adjacent to the first longitudinal side of the inner via, and a third two rows of the six staggered rows are arranged adjacent to the second longitudinal side of the other of the two outer ink vias, each of the first, second, and third two rows having one row of near heaters and one row of far heaters containing five groupings of sixteen heaters each with the one row of near heaters being closer in distance to the ink via than the one row of far heaters;

addressing each of the first, second and third two rows to substantially simultaneous fire up to ten of the plurality of heaters in sixteen consecutive firings; and preventing more than two heaters in any one of the five groupings of sixteen heaters to fire in the substantially simultaneous fire of the up to ten of the plurality of heaters.

* * * * *

UNITED STATES PATENT AND TRADEMARK OFFICE

CERTIFICATE OF CORRECTION

PATENT NO. : 6,764,163 B2
DATED : July 20, 2004
INVENTOR(S) : Frank Edward Anderson et al.

It is certified that error appears in the above-identified patent and that said Letters Patent is hereby corrected as shown below:

Column 10,
Line 61, change the word "often" to -- of ten --

Column 12,
Line 6, change the word "often" to -- of ten --

Signed and Sealed this

Seventh Day of September, 2004

JON W. DUDAS
*Director of the United States Patent and Trademark Office*